US005442980A

United States Patent [19]

Ringer

[11] Patent Number: 5,442,980

[45] Date of Patent: Aug. 22, 1995

[54] NUT DRIVE ADAPTER

[75] Inventor: Cecil D. Ringer, White Rock, S.C.

[73] Assignee: Cooper Industries, Inc., Houston, Tex.

[21] Appl. No.: 125,683

[22] Filed: Sep. 24, 1993

[51] Int. Cl.[6] ..... B25B 13/00
[52] U.S. Cl. ..... 81/177.85
[58] Field of Search ..... 81/177.85, 52, 54, 121.1, 81/124.4, 124.5, 180.1, 180.2

[56] References Cited

U.S. PATENT DOCUMENTS

| | | | |
|---|---|---|---|
| 1,775,402 | 9/1930 | Mandl | 81/177.85 X |
| 4,320,674 | 3/1982 | Ito et al. | 81/54 |
| 4,436,005 | 3/1984 | Hanson | 81/177.85 X |
| 5,282,638 | 2/1994 | Harper | 81/177.85 X |

*Primary Examiner*—D. S. Meislin
*Attorney, Agent, or Firm*—William B. Patterson; Eddie E. Scott

[57] ABSTRACT

A nut drive adapter for use with a power tool includes a splined driven end located coaxially with a square drive. Changing the size of the square drive used with power tools requires only changing the nut drive adapter rather than changing the entire drive housing.

2 Claims, 2 Drawing Sheets

NUT DRIVE ADAPTER

BACKGROUND OF THE INVENTION

The present invention relates to spindle assemblies for use primarily with power tools; more particularly, the present invention relates to nut drive adapters usable with pneumatic or electric tool spindle assemblies.

FITTING BACKGROUND OF THE INVENTION

Power tools are often used to drive a variety of devices such as sockets or screwdriver bits. In the past it has always been necessary to change the entire spindle assembly on the end of power tools whenever it was necessary to change the driving configuration. Thus it was necessary for users of power tools to keep spindle assemblies in stock having half-inch ($\frac{1}{2}$) square drives, three-eighth ($\frac{3}{8}$) inch square drives or quarter ($\frac{1}{4}$) inch square drives. Consequently, it has become expensive in terms of tool inventory and time for owners of power tools to keep an inventory of spindle assemblies available to accommodate whatever drive size is being used.

There is therefore a need in the art to provide a simple, inexpensive method of using a single power tool spindle assembly to drive a variety of tools all having different size drives.

SUMMARY OF THE INVENTION

There is provided by the nut drive adapter of the present invention a simple, inexpensive method for using a single spindle assembly to drive a variety of different tools having different size drives.

The nut drive adapter of the present invention is usable with a rotating power tool, typically a rotating power tool. It includes a driven section and a driver section. The driven section is characterized by having a plurality of external splines. These external splines are sized to interfit within internal splines in a drive housing.

Located coaxially with the driven side is the driver side of the nut drive adapter of the present invention. Typically the driver side is known as a square drive and is sized to mount standard size sockets or other similarly driven tools.

Both the driven side and driver side of the nut drive adapter of the present invention include interlock means. Such interlock means include a spring biased plunger operating substantially perpendicularly to the tool axis. The driven side plunger engages a hole in the drive housing while the driver side plunger engages a hole or a recess in the driven tool such as a socket.

A BRIEF DESCRIPTION OF THE DRAWINGS

A better understanding of the nut drive adapter of the present invention may be had by reference to the drawings wherein.

DESCRIPTION OF THE EMBODIMENTS

Figure 1:
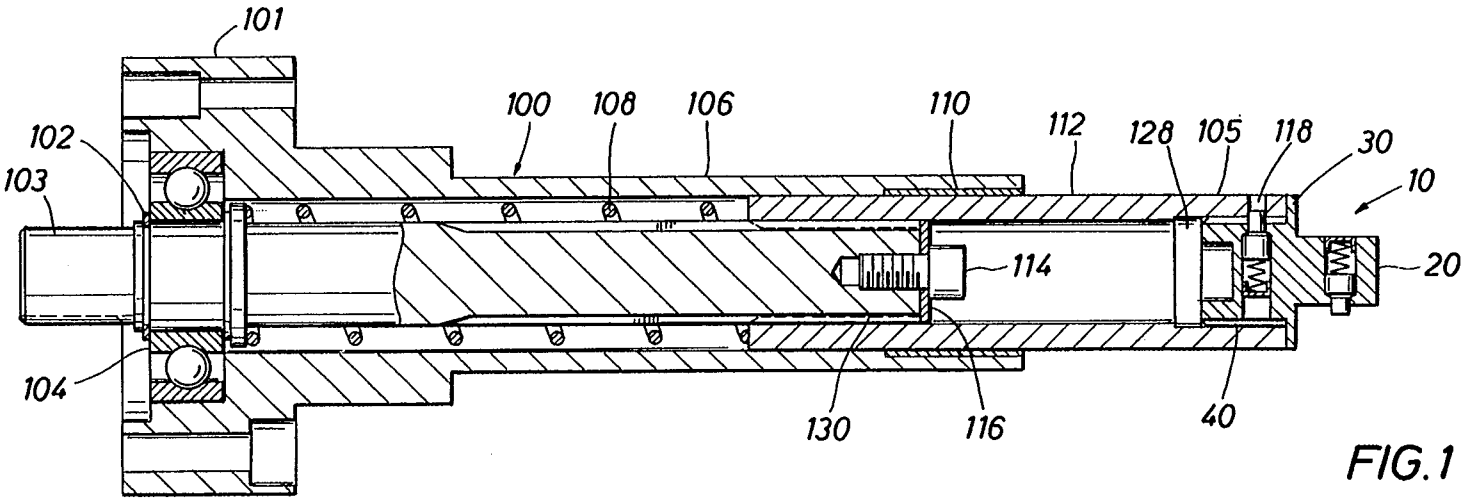
FIG. 1 is a side elevational view in partial section of a power tool spindle assembly including the nut drive adapter of the present invention.
Figure 2:
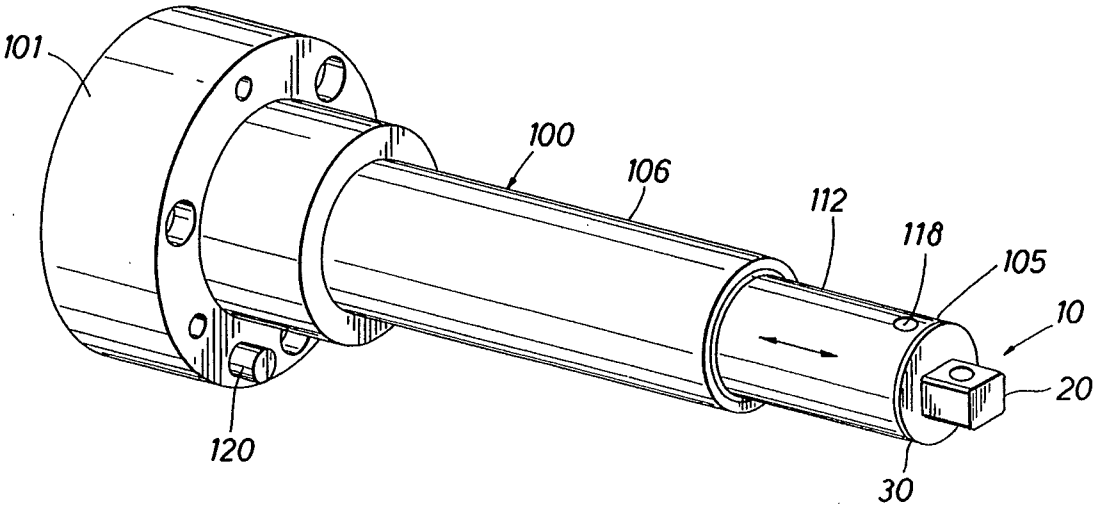
FIG. 2 is a perspective view of the spindle assembly shown in FIG. 1.

The nut drive adapter of the present invention 10 is utilized in the end of a power tool spindle assembly 100. Such spindle assemblies are shown in FIGS. 1 and 2 and are characterized by a first end 101 which engages with a rotating tool, typically a pneumatic or electric tool. Retaining drive assembly 100 to a driving tool (not shown) is press pin 120.

Spindle assembly 100 surrounds driven spindle 103. Spindle 103 is supported within spindle housing 106 by bearing assembly 104 which is retained on driven spindle 103 by retainer ring 102.

Surrounding spindle 103 within spindle housing 106 is compression spring 108. Compression spring 108 works against the mechanical connection of cylindrical hollow drive housing 112 with the spline end 130 of driven spindle 103.

As may be seen in FIG. 1 screw 114 threadably engages the end of driven spindle 103. Washer 116 is held in position by screw 114 which in turn engages the splines of spline end 130. The combination of the mechanical engagement of washer 116 with the splines of spline end 130 and the force of compression spring 108 holds drive housing 112 in place within spindle housing 106.

When driven spindle 103 is rotated it causes drive housing 112 to rotate within sleeve bearing 110 which is press fit within spindle housing 106.

Opposite the first end 101 of spindle assembly 100 is second end 105 into which is inserted nut drive adapter 10 of the present invention.

Figure 3:
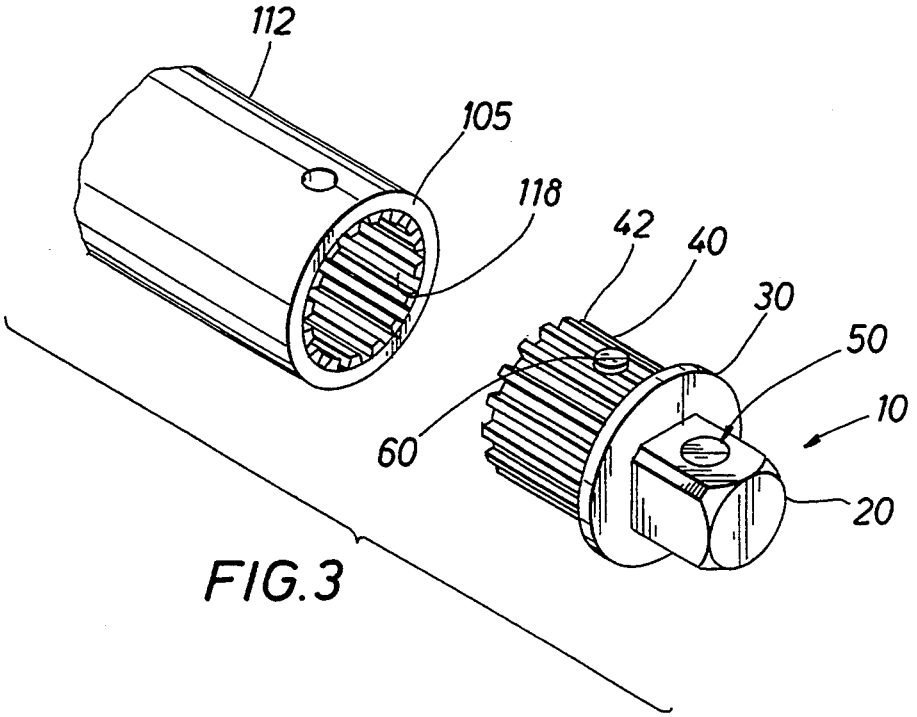
FIG. 3 is exploded perspective view of the end of the drive housing and the nut drive adapter of the present invention.

A better understanding of the attachment of nut drive adapter 10 within cylindrical hollow drive housing 112 may be understood by reference to FIG. 3. Therein it may be seen that external male splines 42 are located where the driven side mechanical interfitment means 40 fits within the internal splines 118 of cylindrical hollow drive housing 112.

As may be understood from FIG. 3 a variety of different configurations of mechanical of interfitment may be used. Shown in the preferred embodiment and in FIG. 3 is a spline drive 42. It will be understood by those of ordinary skill in the art that while a spline drive 42 is shown in the preferred embodiment numerous other styles of mechanical interfitment means may be used to include keyed interfitment.

Opposite and coaxially located with respect to the driven side mechanical interfitment means 40 of the nut drive adapter 10 of the present invention is square drive or driver side mechanical interfitment means 20. The driver side mechanical interfitment means 20 is shown as a square drive in the preferred embodiment. Typically such square drives are half-inch ($\frac{1}{2}$) square drives or three-eighth ($\frac{3}{8}$) square drives. In smaller tools quarter ($\frac{1}{4}$) inch square drives may be used. For applications outside of the U.S. metric square drives may be used. Such square drives are sized to mate with the female end of tools such as sockets or screwdriver bits (not shown).

It will be understood by those of ordinary skill in the art that while a square drive 20 is shown in the preferred embodiment other shapes, typically regular or irregular polygons, may be used in place of square drive 20 without departing from the scope of the present invention.

Figure 4:
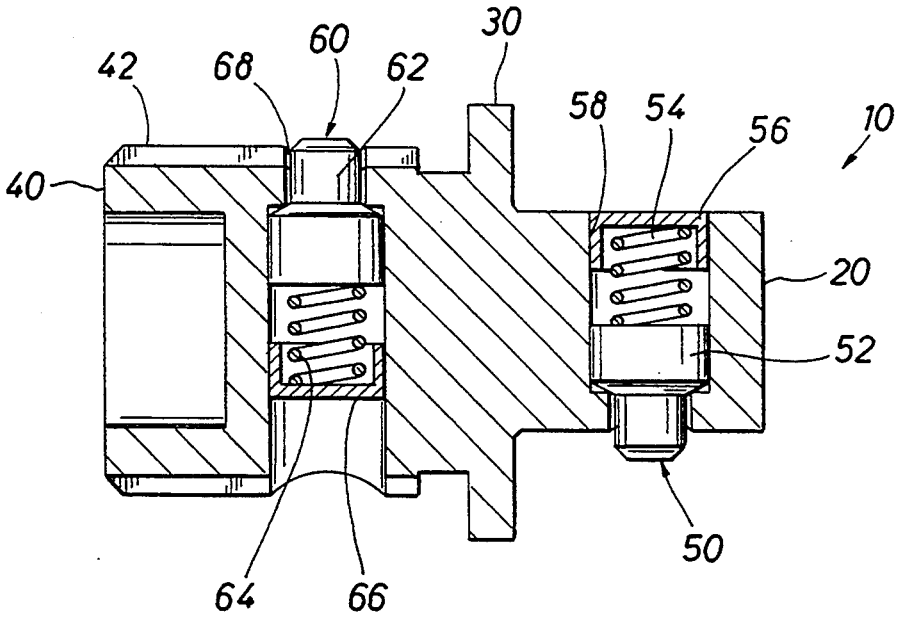
FIG. 4 is a cross-sectional view of the nut drive adapter of the present invention.

By reference to FIG. 4 it will be understood how the nut drive adapter 10 of the present invention obtains its interfitment with drive housing 112 and sockets which engage the square drive 20 of the nut drive adapter 10. Both the driver side mechanical interfitment means 20 and driven side mechanical interfitment means 40 include plunger assemblies 50, 60, respectively. Spline drive plunger assembly 60 is effectively the same as square drive plunger assembly 50 however they are oppositely oriented.

It will be understood by those of ordinary skill in the art that while opposite orientation of the plunger assemblies 50 and 60 are shown in the preferred embodiment they may be oriented at any angle one with respect to the other and not destroy the operability of nut drive adapter 10.

Each plunger assembly 50 and 60 includes three parts. The first part is the plunger 52, 62 which extends beyond the surface of the spline drive 40 or the square drive 20, respectively. Biasing plungers 52, 62 are springs 54, 64. Providing a surface from which springs 54, 64 may exert force away from the central axis of adapter 10 are bushings 56, 66 which are press fit within holes 58, 68 bored into nut drive adapter 10.

Optionally, nut drive adapter 10 of the present invention includes central flange 30. While not essential for the operation of the nut drive adapter central flange 30 may butt against the end of the cylindrical hollow drive housing 112 and thus keep the nut drive adapter 10 in place with respect to housing 112.

To assure proper interfitment of nut drive adapter 10 within cylindrical hollow drive housing 112 a recess 128 is formed within drive housing 112.

OPERATION

When it desired to use the nut drive adapter or driving member 10 of the present invention it is merely necessary to insert the nut drive adapter 10 into drive housing 112. The insertion of nut drive adapter 10 into drive housing 112 will cause plunger 62 to be pressed downward against spring 64. As spline drive 40 passes within spindle drive 112 spring 68 will cause plunger 62 to pass through hole 118 when spline drive 40 is properly seated within drive housing 112. The operator then may place a tool such as a socket over square drive 20 and assure the connection of the socket to square drive 20 by listening for or feeling the inter-engagement of plunger 62 with a hole in the driven tool (not shown).

When it is desired to change nut drive adapters 10 it is merely necessary to insert an object within hole 118 to force plunger 62 against spring 68. This will allow the external male spindle drive 40 to slide outward from cylindrical hollow drive housing 112. At this point other nut drive adapters 10 having a different size square drives 20 may be inserted into cylindrical hollow drive housing 112.

There is thereby provided by the nut drive adapter 10 of the present invention a convenient and easy to use method for changing the size of tools that are used at the end of pneumatic or electric power equipment.

While the nut drive adapter of the present invention has been described by reference to its preferred embodiment, other embodiments may also become apparent to those of ordinary skill in the art once have read the foregoing description. Such other embodiments shall fall within the scope and meaning of the appended claims.

I claim:

1. A nut drive adapter usable with a rotating power tool comprising:

a spindle housing;

a rotatable driven spindle within said spindle housing, said driven spindle having a central axis, said driven spindle further having one end connected to a rotating tool and a spline on the opposite end;

a hollow drive housing, said drive housing having a splined end constructed and arranged to interfit with said splined end of said driven spindle whereby said splined interfitment allows said drive housing to move along said central axis with respect to said driven spindle;

retainer means on said splined end of said driven spindle to prevent said drive housing from disengaging from said driven spindle;

a compression spring around said driven spindle and within said spindle housing, said compression spring having a first end in contact with said driven spindle, said compression spring having a second end in contact with said splined end of said drive housing whereby said compression spring provides a force tending to move said drive housing away from said retainer means;

a driven side male mechanical interfitment means for imparting a rotational force upon said nut drive adapter when said drive housing is rotated;

first mechanical interlock means to retain said nut driver adapter within said driven side male mechanical interfitment means, said first mechanical interlock means constructed and arranged substantially perpendicular to said driven side male mechanical interfitment means;

driver side male mechanical interfitment means to mate with a nut, said driver side male mechanical interfitment means located substantially coaxial with said driven side male mechanical interfitment means; and second mechanical interlock means to retain said nut on said nut drive adapter, said second mechanical interlock means located on said driver side male mechanical interfitment means, said second mechanical interlock means constructed and arranged to be substantially perpendicular to said driver side male mechanical interfitment means.

2. The nut drive adapter as described in claim 1, wherein said spindle housing also surrounding said splined end of said drive housing.

* * * * *